US005160410A

United States Patent [19]

Tammi et al.

[11] Patent Number: 5,160,410

[45] Date of Patent: Nov. 3, 1992

[54] PRESS CYNLINDER SHELL STRUCTURE FOR PAPER MACHINE PRESS SECTION

[75] Inventors: Pekka Tammi; Kari Marjoniemi, both of Tampere, Finland

[73] Assignee: Hollming Oy, Rauma, Finland

[21] Appl. No.: 668,593

[22] Filed: Mar. 13, 1991

[30] Foreign Application Priority Data

Mar. 14, 1990 [FI] Finland ..... 901282

[51] Int. Cl.[5] ..... D21F 3/08

[52] U.S. Cl. ..... 162/358.1; 29/130; 29/132; 162/361

[58] Field of Search ..... 162/358, 361; 29/130, 29/132; 100/160, 169

[56] References Cited

U.S. PATENT DOCUMENTS 2,997,406 8/1961 Freeman et al. ..... 29/130
3,152,387 10/1964 Macleod ..... 29/130
3,447,600 6/1969 Greenee ..... 29/130
3,559,306 8/1971 Brafford ..... 29/132
4,559,106 12/1985 Skytta et al. ..... 162/358
4,998,333 3/1991 Skytta ..... 29/130

FOREIGN PATENT DOCUMENTS 79368 8/1989 Finland .

*Primary Examiner*—Karen M. Hastings
*Attorney, Agent, or Firm*—Dellett, Smith-Hill and Bedell

[57] ABSTRACT

The invention is related to a cylindrical shell structure (1) for paper machine press section, said shell structure being arranged to enclose at least four support rolls (5, 6, 7). According to the invention the shell structure (1) has at least three layers so that the outer face (4) and inner face (2) of the shell (1) are of a resilient, durable material, and the core (3) is of an elastic material having a high shear elasticity.

20 Claims, 1 Drawing Sheet

PRESS CYNLINDER SHELL STRUCTURE FOR PAPER MACHINE PRESS SECTION

The present invention relates to a shell structure for a paper machine press section.

Conventional constructions use rubber-covered steel rolls as the press rolls of the paper machine press section, said rolls providing the nip for water removal from the web. As necessary, either one or two rubber-covered rolls are use.

Because the goal is to achieve a nip of maximum width, combined with maximally homogeneous and high linear pressure, rubber-covered rolls do not offer an optimal solution. Increasing the diameter of the rolls can, of course, permit a wider nip but the uneven distribution of nip pressure still remains a problem.

Disclosed in FI patent publication 79368 is a roll construction for a wide-nip press having support rolls arranged parallel with the axis of the felt roll, said rolls having a shell arranged enclosing the rolls, said shell being pressed against the felt roll via the web by virtue of the support rolls.

The arrangement disclosed in the publication is not detailed up to a specific embodiment of the shell structure that might implement an effective function of said arrangement. The shell should facilitate a sufficiently large local displacement without exceeding the maximum allowable stress of the outer face of the shell. On the other hand, the local stiffness of the structure should be sufficient to achieve a desired compressive pressure over the entire nip width. The shell structure is, however, described to be fabricated from a resilient material such as steel, carbon fiber or other suitable material. For the proper function of the equipment, the specific structure of the shell is of particular importance.

It is an object of the present invention to overcome the drawbacks of the above-described technique and to achieve an entirely novel type of shell structure for paper machine press section.

The invention is based on fabricating the shell using an at least three-layer structure in which an elastic core is covered on both sides with surface layers of higher stiffness.

The invention provides outstanding benefits.

The nip width can be designed up to twice the width achievable by conventional techniques, and moreover, the nip pressure can be maintained constant over the entire nip width.

BRIEF DESCRIPTION OF THE DRAWINGS

The invention is next examined in detail with the help of an exemplifying embodiment illustrated in the attached drawings.

DETAILED DESCRIPTION

Figure 1:
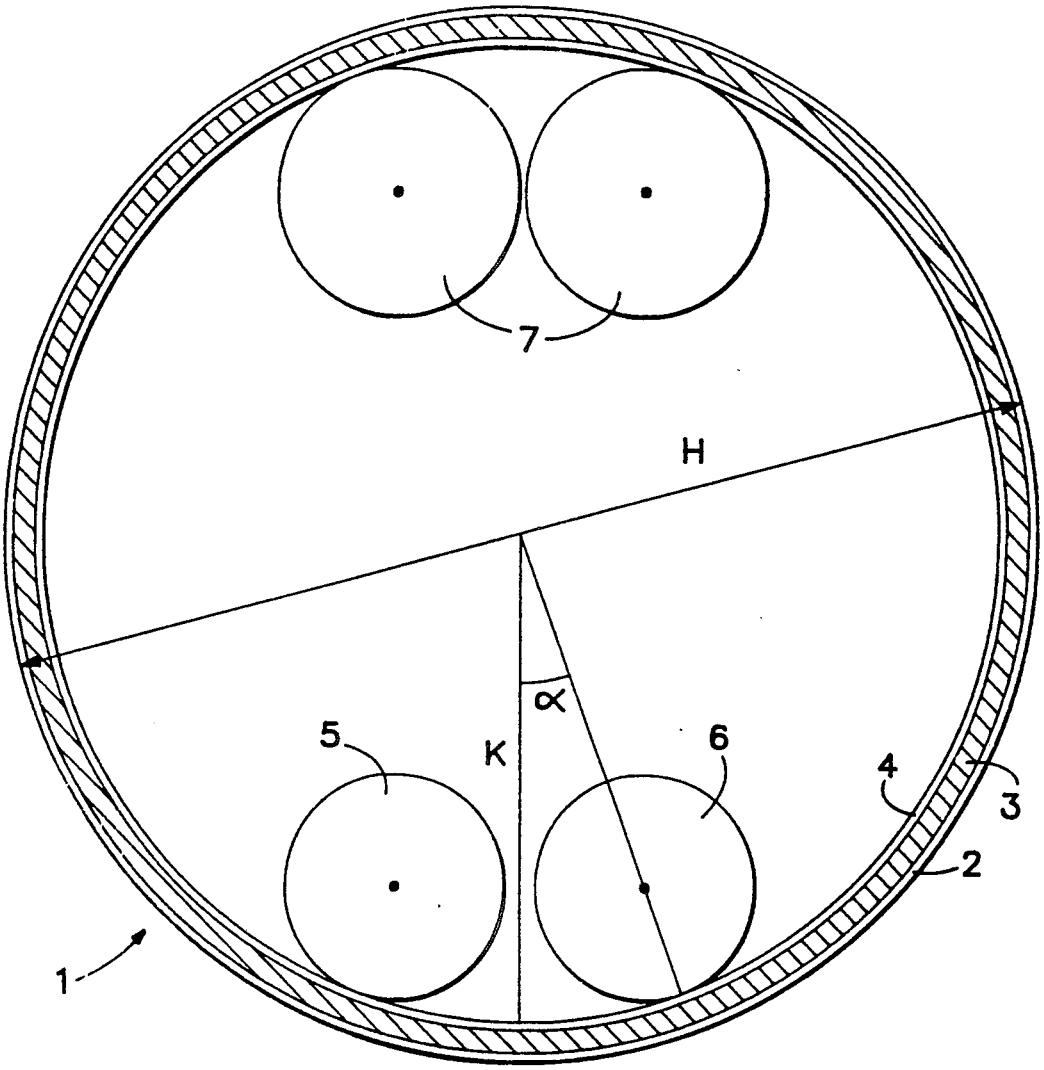
FIG. 1 shows a side view of a shell structure in accordance with the invention in whole.

According to FIG. 1, a shell structure 1 is adapted about support rolls 5, 6, 7. The shell structure extends over the entire width of the web in the cross direction of the web. A typical diameter H of the shell structure 1 is approx. 1 m. The shell structure is composed of a resilient but durable outer face 2, elastic core 3 and inner face 4 whose properties are practically identical to those of the outer face 2. The position of the rolls 5 and 6 can be varied according to the loading requirements. During the tests performed, the rolls 5 and 6 were adjusted symmetrically about the center line K while the angle $\alpha$ subtended between the center line K and the center point of the roll 6 was approx. 21°.

Figure 2:
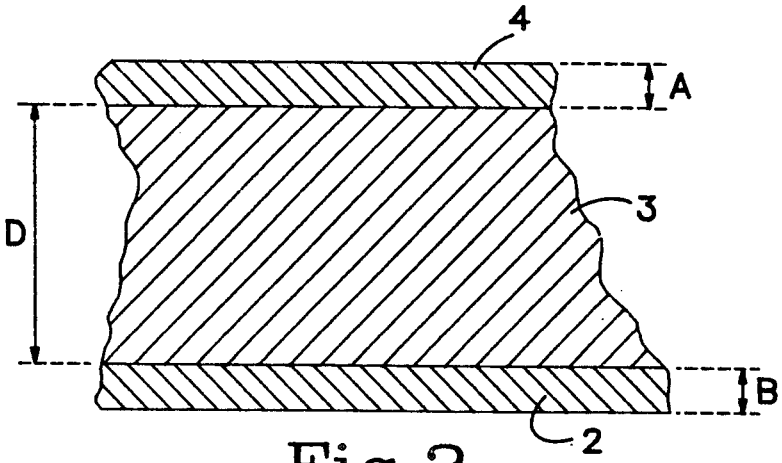
FIG. 2 shows a detail of the shell structure illustrated in FIG. 1.

With the help of computer calculations, the layered structure illustrated in FIG. 2 was selected, said structure having an epoxy or urethane elastomer modified for extreme elasticity as the core 3. The materials of the outer faces 2 and inner faces 4 were carbon-fiber-reinforced epoxy. The radial modulus of elasticity in this material was in the range 50–100 GPa.

Since the specifications were set as to achieve a nip width of 250 mm and 4 $N/mm^2$ average nip pressure, the roll of 1 m diameter was dimensioned as follows:

- thickness of core 3: D=25 mm, and
- equal thicknesses A and B of outer face 2 and inner face 4: A=B=approx. 5 mm.

The core 3 had a modulus of elasticity of 1350 $N/mm^2$ and a shear modulus of 500 $N/mm^2$. The results of computations were verified using a model scaled down by 1:5.

The dimensioning rules were characterized by a requirement stating that a sufficiently large local displacement must be achieved without exceeding the maximum allowable stress of the outer face. In addition, the local stiffness of the structure had to be sufficient for reaching a desired compressive loading over the entire nip width in the press. The stiffness and strength behaviour of the shell 1 can be varied over a wide range by altering the stiffness and strength properties of reinforced plastic composites. The local stiffness of the shell 1 can be changed in the structure by altering, e.g., the thickness and properties of the core 3. The thickness D of the core 3 for a roll of 1 m diameter can be varied within, e.g., 10–50 mm while correspondingly the thicknesses A and B of the surface layers is varied within 5–25 mm. Advantageously, the thickness of the shell structure 1 is approx. 2–5%, preferably approx. 3.5%, of the total diameter H of the shell structure 1. Furthermore, the thickness D of the core 3 is approx. 55–85%, preferably approx. 70%, of the total thickness of the shell structure 1.

Suitable materials for the surface layers 2 and core 4 are, e.g., glass or aramide fiber reinforced resins, of which further suitable of thermoset plastics are, e.g., different polyester, vinylester, methacrylate or phenol based resins. Of thermoplastics suitable are, e.g., polyethene, polyamide, polypropene and other resin systems compatible with the composites production techniques.

A shell structure in accordance with the invention can be fabricated, for instance, by:

- hand lay-up,
- RTM techniques,
- filament winding, or
- prepreg laying.

In hand lay-up, the reinforcing fabrics are impregnated with resin using, e.g., a brush or roller. The reinforcing layers are laminated layer by layer in a desired order up to the predetermined number of layers. The reinforcement is introduced in the form of chopped strand mats or different kinds of knit fabrics. The mold is provided by single-surface structure, which for the case of the shell structure is a cylindrical tube.

The RTM (Resin Transfer Molding) method is based on the use of closed molds (confined on both sides), in which the reinforcement or preforms made thereof are placed without preimpregnation in the first stage while the resin is injected into the mold in the second stage using either overpressure or vacuum (or both) to assist the process.

In the filament winding method, the reinforcement is introduced in preimpregnated form in layers onto a rotating mandrel. The typical reinforcement used in filament winding is called roving, which is a bundle of parallel strands. The roving bundles are wound onto the mandrel in single or multiple rovings at a time. Suitable reinforcements are also such fabrics as mats and knit fabrics. The preimpregnation of the reinforcing material with the resin is typically carried out in separate impregnation vats prior to their winding onto the mandrel.

The basic components of the resin matrix composite, that is, the reinforcement and resin, can also be delivered in the form of a prefabricated product in which the reinforcement is already combined with the resin. When using thermoplastics, the resin component can be brought into a workable state by reheating prior to the final fabrication stage. The use of thermoset resins requires precuring of the resin component into a state called B-stage that makes the resin component pliable and easy to form. Final curing of the resin is carried out using pressure and elevated temperature. The latter described method of using prefabricated materials called prepregs is suitable for use in the fabrication of the shell structure in accordance with the invention. The filament winding method is also applicable especially for large cylindrical shapes.

What is claimed is:

1. A press cylinder for use in a paper machine press section, said press cylinder comprising:

a plurality of support rolls, and a cylindrical shell structure enclosing the support rolls, the shell structure having a core layer of an elastic material, an outer face layer of a resilient material having a greater stiffness than the material of the core layer, and an inner face layer of a material with substantially identical properties to the material of the outer face layer, the core layer being disposed between the inner face layer and the outer face layer.

2. A press cylinder according to claim 1, wherein the material of the inner face layer is carbon fiber reinforced epoxy.

3. A press cylinder according to claim 1, wherein the material of the outer face layer is carbon fiber reinforced epoxy.

4. A press cylinder according to claim 1, wherein the material of the core layer is a polyurethane elastomer.

5. A press cylinder according to claim 1, wherein the thickness of the shell structure is approximately 2–5 percent of the total diameter of the shell structure.

6. A shell structure according to claim 5 wherein the thickness of the shell structure is approximately 3.5 percent of the diameter of the shell structure.

7. A shell structure according to claim 1, wherein the thickness of the core is approximately 55–85 percent of the total thickness of the shell structure.

8. A shell structure according to claim 7, wherein the thickness of the core layer is approximately 70 percent of the total thickness of the shell structure.

9. A press cylinder according to claim 1, wherein said plurality of support rolls comprises four support rolls having external peripheries that engage the inner periphery of the shell structure in rolling fashion.

10. A press cylinder according to claim 9, wherein said four support rolls are an upper pair of support rolls and a lower pair of support rolls, the lower pair of support rolls being spaced from the upper pair of support rolls.

11. A press cylinder according to claim 1, wherein the radial modulus of elasticity of the material of the inner face layer is in the range 50–100 GPa and the radial modulus of elasticity of the material of the outer face layer is in the range 50–100 GPa.

12. A press cylinder according to claim 1, wherein the material of the core layer has a modulus of elasticity of about 1350 $N/mm^2$ and a shear modulus of about 500 $N/mm^2$.

13. A press cylinder in a paper machine press section, said press cylinder comprising:

at least four support rolls each having an external peripheral surface, and a hollow cylindrical shell structure having an internal peripheral surface, the shell structure enclosing the support rolls and the external peripheral surfaces of the support rolls being in rolling engagement with the internal peripheral surface of the shell structure, the shell structure having a core layer of an elastic material having a high shear elasticity, an outer face layer of a resilient, durable material having a greater stiffness than the material of the core layer, and an inner face layer of a with substantially identical properties to the material of the outer face layer, the core layer being disposed between the inner face layer and the outer face layer.

14. A press cylinder according to claim 13, wherein the material of the inner face layer and the outer face layer is carbon fiber reinforced epoxy.

15. A press cylinder according to claim 13, wherein the radial modulus of elasticity of the material of the inner face layer is in the range 50–100 GPa and the radial modulus of elasticity of the material of the outer face layer is in the range 50–100 GPa.

16. A press cylinder according to claim 13, wherein the material of the core layer is a polyurethane elastomer.

17. A press cylinder according to claim 13, wherein the material of the core layer has a modulus of elasticity of about 1350 $N/mm^2$ and a shear modulus of about 500 $N/mm^2$.

18. A press cylinder according to claim 13, wherein the thickness of the shell structure is approximately 2–5 percent of the total diameter of the shell structure.

19. A shell structure according to claim 13, wherein the thickness of the core layer is approximately 55–85 percent of the total thickness of the shell structure.

20. A press cylinder according to claim 13, wherein the four support rolls are an upper pair of support rolls and a lower pair of support rolls, the lower pair of support rolls being spaced from the upper pair of support rolls.

* * * * *